US009116474B2

(12) United States Patent
Nishinoue et al.

(10) Patent No.: US 9,116,474 B2
(45) Date of Patent: Aug. 25, 2015

(54) IMAGE FORMING APPARATUS AND TRANSLATION CONTROL METHOD

(71) Applicant: Konica Minolta, Inc., Chiyoda-ku, Tokyo (JP)

(72) Inventors: Kazunori Nishinoue, Tokyo (JP); Hiroshi Matsumoto, Tokyo (JP); Makoto Fujii, Tokyo (JP); Miho Yamano, Tokyo (JP); Taizou Oonishi, Tokyo (JP)

(73) Assignee: KONICA MINOLTA, INC. (JP)

( * ) Notice: Subject to any disclaimer, the term of this patent is extended or adjusted under 35 U.S.C. 154(b) by 84 days.

(21) Appl. No.: 14/087,851

(22) Filed: Nov. 22, 2013

(65) Prior Publication Data

US 2014/0147169 A1 May 29, 2014

(30) Foreign Application Priority Data

Nov. 26, 2012 (JP) ..... 2012-257529

(51) Int. Cl.
*G03G 15/20* (2006.01)
*G03G 21/16* (2006.01)

(52) U.S. Cl.
CPC ..... *G03G 15/2017* (2013.01); *G03G 21/1685* (2013.01); *G03G 2215/20* (2013.01)

(58) Field of Classification Search
CPC ..... G03G 15/2017; G03G 21/1685; G03G 15/22; G03G 15/20; G03G 2215/20; G03G 2215/2006
USPC ..... 399/122, 320
See application file for complete search history.

(56) References Cited

U.S. PATENT DOCUMENTS

| | | | | |
|---|---|---|---|---|
| 5,561,503 | A * | 10/1996 | Masuda | 399/155 |
| 7,142,793 | B1 * | 11/2006 | Potter et al. | 399/69 |
| 7,431,551 | B2 * | 10/2008 | Liu | 414/331.09 |
| 8,879,940 | B2 * | 11/2014 | Kasamatsu et al. | 399/68 |
| 2010/0104340 | A1 * | 4/2010 | Kitadai et al. | 399/400 |
| 2010/0278551 | A1 * | 11/2010 | Maruko et al. | 399/68 |
| 2012/0063822 | A1 * | 3/2012 | Funabiki et al. | 399/323 |
| 2012/0195606 | A1 * | 8/2012 | Miyajima et al. | 399/33 |
| 2013/0148994 | A1 * | 6/2013 | Fukai | 399/67 |

FOREIGN PATENT DOCUMENTS

| | | | |
|---|---|---|---|
| JP | 2006-91224 | A | 4/2006 |
| JP | 2007-148336 | A | 6/2007 |
| WO | 2010/021219 | A1 | 2/2010 |

OTHER PUBLICATIONS

Notice of the Reasons for Rejections dated Oct. 28, 2014 for the corresponding Japanese Patent Application 2012-257529, with English translation.

* cited by examiner

*Primary Examiner* — Christ Mahoney
(74) *Attorney, Agent, or Firm* — Cantor Colburn LLP

(57) ABSTRACT

An image forming apparatus includes: a fixing unit that heats and presses a recording sheet having a toner image formed thereon, by means of a fixing nip portion to thereby fix the toner image to the recording sheet; a translation section that translates the fixing unit in a direction that is orthogonal to a conveying direction of the recording sheet; and a controlling section that controls the translation section so that the fixing unit is translated by a translation amount that is one-half of a value obtained by subtracting an image width of the toner image from a sheet width of the recording sheet.

8 Claims, 7 Drawing Sheets

IMAGE FORMING APPARATUS AND TRANSLATION CONTROL METHOD

CROSS REFERENCE TO RELATED APPLICATIONS

This application is entitled and claims the benefit of Japanese Patent Application No. 2012-257529, filed on Nov. 26, 2012, the disclosure of which including the specification, drawings and abstract is incorporated herein by reference in its entirety.

BACKGROUND OF THE INVENTION

1. Field of the Invention

The present invention relates to an image forming apparatus and a translation control method.

Description of Related Art

Generally, in an image forming apparatus that forms an image by using an electrophotographic process, the surface of an image bearing member (a photoconductor drum or the like) is electrically charged to a predetermined potential, and image light exposure is performed thereto to form an electrostatic latent image on the surface. Then, the latent image on the surface of the photoconductor drum is developed by a development section by using a developer (toner), and visualized as a toner image. The toner image thus obtained is transferred onto a recording sheet conveyed to the photoconductor drum, the recording sheet carrying the toner image is conveyed to a fixing unit, and an unfixed toner image on the recording sheet is thermally fixed by the fixing unit, thereby forming an image on the recording sheet.

In an image forming apparatus, when processing a large quantity of recording sheets of the same size at a fixing unit, edge portions of the recording sheets continuously contact against the same positions on a fixing roller of the fixing unit. Therefore, there is a known problem of scratches (hereunder, referred to as "sheet edge scratches") created along the circumference of the fixing roller at the positions that the edge portions of the recording sheets contact against, which consequently deteriorates the image quality due to the sheet edge scratches.

To solve the foregoing problem pertinent in the art, an image forming apparatus has been developed that is adapted so as to continually change the positions at which edge portions of recording sheets contact against a fixing roller by translating the fixing unit in a direction orthogonal to the conveying direction of the recording sheets (for example, see Japanese Patent Application Laid-Open No. 2006-91224).

However, according to the technology described in the aforementioned Japanese Patent Application Laid-Open No. 2006-91224, as a result of translating the fixing unit, an abrasion difference arises between parts that edge portions of the recording sheets contact against and parts that edge portions of the recording sheets do not contact against on a surface layer of a heating member (for example, a heating roller, a heating belt or the like) and a pressing member (for example, a pressing roller, a pressing belt or the like) of the fixing unit. Consequently, there has been a problem of a gloss difference in an image that is ultimately formed on a recording sheet occurring when an unfixed toner image on the recording sheet is thermally fixed by the surface layers of a heating member and a pressing member in which an abrasion difference has arisen. The gloss difference occurs, in particular, in a case where toner images of the same image or of the same image width are formed successively on recording sheets.

SUMMARY OF THE INVENTION

An object of the present invention is to provide an image forming apparatus and a translation control method that, in a case where a fixing unit is translated in a direction that is orthogonal to a conveying direction of a recording sheet, can prevent a gloss difference from occurring in an image that is ultimately formed on the recording sheet.

To achieve at least one of the above mentioned objects, an image forming apparatus reflecting one aspect of the present invention includes: a fixing unit that heats and presses a recording sheet having a toner image formed thereon, by means of a fixing nip portion to thereby fix the toner image onto the recording sheet; a translation section that translates the fixing unit in a direction that is orthogonal to a conveying direction of the recording sheet; and a controlling section that controls the translation section so that the fixing unit is translated by a translation amount that is equal to or less than one-half of a value obtained by subtracting an image width of the toner image from a sheet width of the recording sheet.

Preferably, in the above-mentioned image forming apparatus, the controlling section controls the translation section so that the translation amount becomes one-half of a value obtained by subtracting the image width of the toner image from the sheet width of the recording sheet.

Preferably, in the above-mentioned image forming apparatus, the image width is an image guarantee area width that defines a maximum width that guarantees a quality of a toner image to be formed on the recording sheet.

Preferably, in the above-mentioned image forming apparatus, the image width is an actual image area width that defines a maximum width of an actual image area in which a toner image is to be formed on the recording sheet.

A translation control method for an image forming apparatus reflecting another aspect of the present invention is a translation control method for an image forming apparatus that includes a fixing unit that heats and presses a recording sheet having a toner image formed thereon, by means of a fixing nip portion to thereby fix the toner image onto the recording sheet, the method including: a first step of calculating a value that is one-half of a value obtained by subtracting an image width of the toner image from a sheet width of the recording sheet as a translation amount of the fixing unit; and a second step of controlling so that the fixing unit is translated in a direction that is orthogonal to a conveying direction of the recording sheet by a translation amount that is equal to or less than the translation amount calculated in the first step.

Preferably, in the above-mentioned translation control method, the second step is a step of controlling so that the fixing unit is translated in a direction that is orthogonal to a conveying direction of the recording sheet with the translation amount calculated in the first step.

Preferably, in the above-mentioned translation control method, the image width is an image guarantee area width that defines a maximum width that guarantees a quality of a toner image to be formed on the recording sheet.

Preferably, in the above-mentioned translation control method, the image width is an actual image area width that defines a maximum width of an actual image area in which a toner image is to be formed on the recording sheet.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

The present embodiment is described in detail hereinafter based on the accompanying drawings.

[Configuration of Image Forming Apparatus 100]

Figure 1:
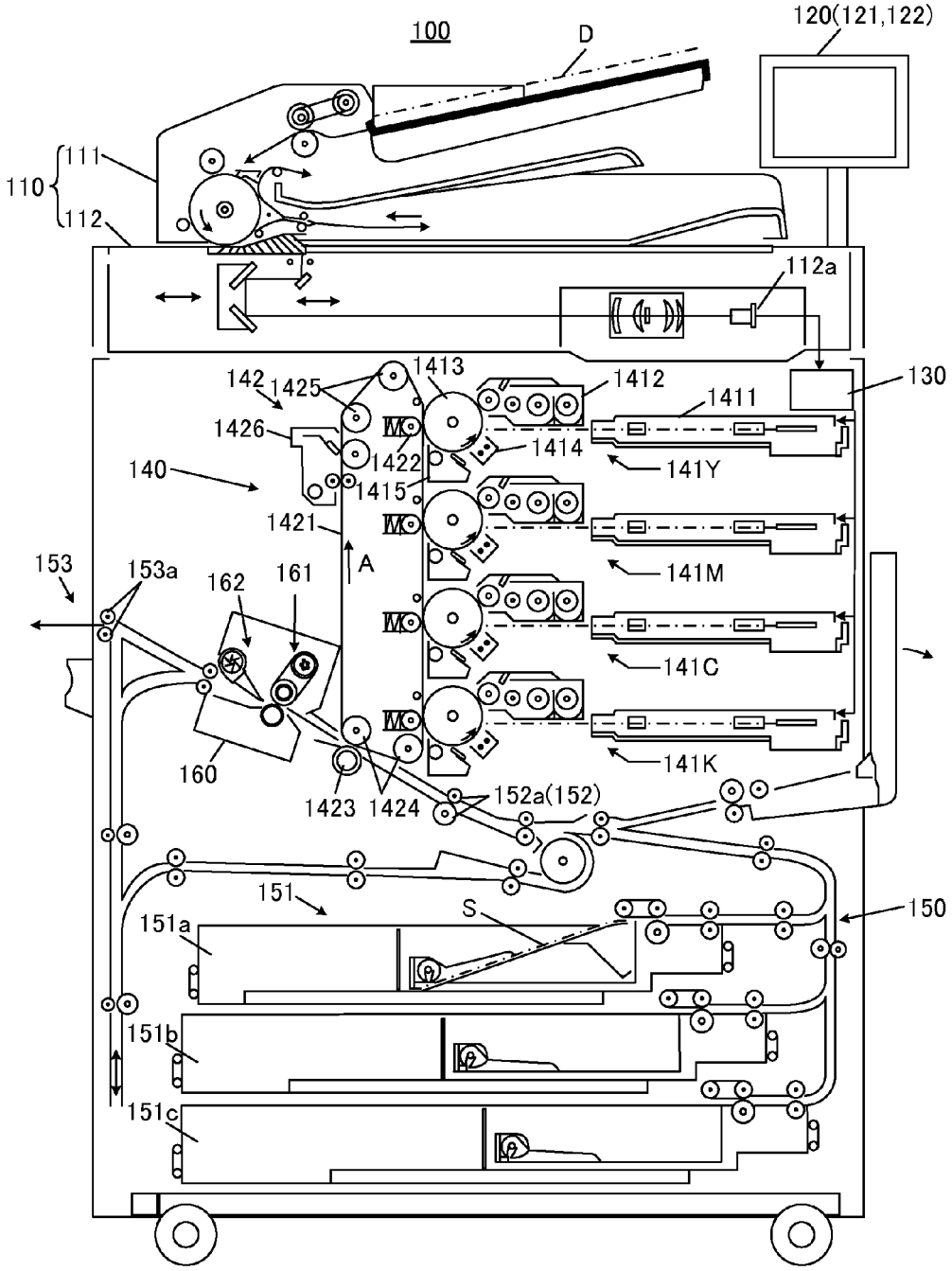
FIG. 1 is a vertical sectional view of an image forming apparatus of the present embodiment.
Figure 2:
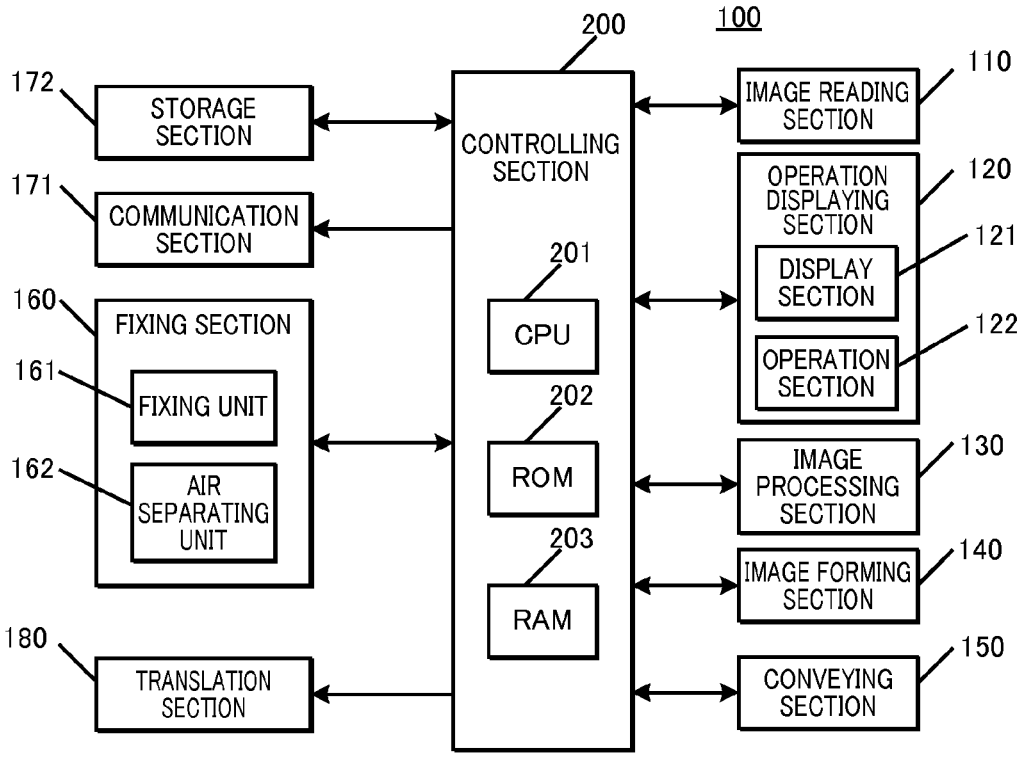
FIG. 2 is a control block diagram of the image forming apparatus of the present embodiment.

Image forming apparatus 100 illustrated in FIGS. 1 and 2 is a color image forming apparatus of an intermediate transfer type that utilizes the electrophotographic process technology. That is, image forming apparatus 100 transfers toner images of respective colors of C (cyan), M (magenta), Y (yellow), and K (black) formed on a photoconductor onto an intermediate transfer member (primary transfer), superposes the toner images of the four colors on the intermediate transfer member, and then transfers the images onto a recording sheet (secondary transfer), thereby forming an image.

In addition, image forming apparatus 100 employs a tandem type in which photoconductors corresponding to the four colors of C, M, Y, and K are disposed in series along a travelling direction of an intermediate transfer member, and toner images of respective colors are sequentially transferred onto the intermediate transfer member in a single procedure.

Image forming apparatus 100 includes controlling section 200, image reading section 110, operation displaying section 120, image processing section 130, image forming section 140, conveying section 150, fixing section 160, translation section 180, and controlling section 200.

Controlling section 200 includes central processing unit (CPU) 201, read only memory (ROM) 202, random access memory (RAM) 104, and the like. CPU 201 reads out a program corresponding to the content of processing from ROM 103, loads the program in RAM 203, and performs a centralized control of operations of the blocks of image forming apparatus 100 in conjunction with the loaded program. At this time, various kinds of data stored in storage section 172 are referenced. Storage section 172 is composed of a non-volatile-semiconductor memory (so-called flash memory) or a hard disk drive, for example. Print job information relating to a print job that is assigned to image forming apparatus 100 is stored in storage section 172. The term "print job information" refers to information in which image data and settings information that is necessary for image forming are associated with each other. The term "settings information" refers to information such as, for example, sheet size, magnification, density information, number of output sheets, number of output copies, and post-processing settings. Image guarantee area width information that is previously set in image forming apparatus 100 is also stored in storage section 172. The image guarantee area width information defines a maximum width that guarantees the quality of a toner image to be formed on recording sheet S (for example, a width obtained by narrowing both the left and right edges by 4 [mm], respectively, relative to the sheet width of the recording sheet).

Controlling section 200 exchanges various kinds of data, via communication section 171, with an external apparatus (for example, a personal computer) connected through a communication network such as local area network (LAN) and wide area network (WAN). For example, controlling section 200 receives image data (input image data) sent from an external device, and forms an image on a recording sheet based on the received image data. Communication section 171 is composed of a communication control card such as a LAN card, for example.

Image reading section 110 includes an automatic document feeder 111 called auto document feeder (ADF), document image scanning device 112, and the like.

Automatic document feeder 111 conveys a document D placed on a document tray by a conveying mechanism and outputs the document D to document image scanning device 112. Automatic document feeder 111 can successively read images (including images on both sides) of documents D that are placed on the document tray.

Document image scanning device 112 optically scans document D conveyed onto a contact glass from automatic document feeder 111 or document D placed on the contact glass, brings light reflected from the document D into an image on a light reception surface of charge coupled device (CCD) sensor 112*a*, and reads the image of the document. Image reading section 110 generates data of the input image based on results of the reading of document image scanning device 112. The data of the input image is subjected to a predetermined image process at image processing section 130.

Operation displaying section 120 is a liquid crystal display (LCD) provided with a touch panel for example, and functions as display section 121 and operation section 122. Display section 121 displays states of various kinds of operation screens and images, operating conditions of functions, and the like according to a display control signal input from controlling section 200. Operation section 122 includes various kinds of operation keys such as numeric keys and a start key, receives various kinds of inputting operation by a user, and outputs an operation signal to controlling section 200.

Image processing section 130 includes a circuit that performs, on the input image data, a digital image process according to an initial setting or user setting, and the like. For example, under the control of controlling section 200, image processing section 130 performs a tone correction based on tone correction data (tone correction table). In addition, image processing section 130 performs, on the input image data, various kinds of corrections such as, other than the tone correction, a color correction, a shading correction, a compression process, and the like. Image forming section 140 is controlled based on the image data having been subjected to the foregoing processes.

Image forming section 140 includes image forming units 141Y, 141M, 141C, and 141K that form, based on the input image data, images of colored toners of Y component, M component, C component, and K component, intermediate transfer unit 142, and the like.

Image forming units 141Y, 141M, 141C, and 141K for Y component, M component, C component, and K component have configurations similar to each other. For convenience in illustration of the drawings and description, common components are denoted by the same reference numerals, and in the case where descriptions are separately given, Y, M, C or K is attached to the reference numeral. In FIG. 1, reference numerals are given only for elements of image forming unit 141Y for Y component, and reference numerals for elements of image forming units 141M, 141C, and 141K are omitted.

A configuration of image forming units 141 is described by taking image forming unit 141Y as an example. Image forming unit 141Y includes light exposure device 1411, developing device 1412, photoconductor drum 1413 that functions as an image bearing member, charging device 1414, drum cleaning device 1415, and the like.

Photoconductor drum 1413 is, for example, a negative charge-type organic photoconductor (OPC) having an undercoat layer (UCL), a charge generation layer (CGL), and a charge transport layer (CTL) that are sequentially laminated on the circumferential surface of a conductive cylindrical body made of aluminum (aluminum-based tube).

Charging device 1414 negatively charges the entire surface of photoconductor drum 1413. Light exposure device 1411 is composed of a semiconductor laser, for example, and irradiates laser light corresponding to the image of each color component onto photoconductor drum 1413. Positive electric charge is generated in a charge generation layer of photoconductor drum 1413, and is transported to the surface of the charge transport layer, whereby the electric charge (negative electric charge) on the surface of photoconductor drum 1413 is neutralized. Electrostatic latent images for the respective color components are formed on the surface of photoconductor drum 1413 due to a potential difference from the surrounding area.

Developing device 1412 contains therein developers of the color components (for example, two-component developers each composed of a toner having a small particle size and a magnetic carrier), and causes toner of each color component to adhere onto the surface of photoconductor drum 1413 so as to visualize an electrostatic latent image, thereby forming a toner image.

Drum cleaning device 1415 includes a drum cleaning blade to be brought into sliding contact with the surface of photoconductor drum 1413. Residual toner remaining on the surface of photoconductor drum 1413 after the primary transfer is scraped and removed by the drum cleaning blade.

Intermediate transfer unit 142 includes intermediate transfer belt 1421 serving as an intermediate transfer member, primary transfer roller 1422, secondary roller 1423, drive roller 1424, driven roller 1425, belt cleaning device 1426, and the like.

Intermediate transfer belt 1421 is composed of an endless belt, and is wrapped around drive roller 1424 and driven roller 1425. Intermediate transfer belt 1421 moves in an arrow A direction at a constant speed along with the rotation of drive roller 1424. When intermediate transfer belt 1421 is brought into pressure contact with photoconductor drum 1413 by primary transfer roller 1422, color toner images are superposed in sequence and thereby primary-transferred onto intermediate transfer belt 1421. Then, intermediate transfer belt 1421 is brought into pressure contact with a recording sheet S by secondary roller 1423, whereby the toner images primary-transferred on intermediate transfer belt 1421 are secondary-transferred on the recording sheet S.

Belt cleaning device 1426 includes a belt cleaning blade to be brought into sliding contact with the surface of intermediate transfer belt 1421. Residual toner remaining on the surface of intermediate transfer belt 1421 after the secondary transfer is scraped and removed by the belt cleaning blade.

Fixing section 160 applies heat and pressure to the recording sheet S conveyed thereto at a fixing nip portion, thereby fixing the toner images on the recording sheet S. Fixing section 160 includes fixing unit 161 and air separating unit 162. Fixing unit 161 allows the recording sheet S to pass through the fixing nip portion formed by a pair of fixing members brought into pressure contact with each other, and applies heat of a heat source to the toner images transferred on the recording sheet S, thereby fixing the toner images onto the recording sheet S. Air separating unit 162 separates recording sheet S from the fixing members by discharging compressed air towards recording sheet S from an eject side of recording sheet S in the fixing nip portion.

Conveying section 150 includes sheet feed section 151, conveying mechanism 152, sheet ejecting section 153, and the like. Recording sheets (standard type sheets and special type sheets) S each discriminated based on the basis weight, size, and the like thereof are stored, according to predetermined types, in respective sheet tray units 151*a* to 151*c* configuring sheet feed section 151.

The recording sheets S stored in sheet tray units 151*a* to 151*c* are output one by one from the uppermost, and conveyed to image forming section 140 by conveying mechanism 152 including a plurality of conveying rollers such as registration rollers 152*a*. At this time, a registration section in which registration rollers 152*a* are arranged corrects the obliqueness of the fed recording sheet S and adjusts the conveyance timing. Then, in image forming section 140, the toner image on intermediate transfer belt 1421 is secondary-transferred onto a surface of the recording sheet S, and a fixing step is performed in fixing section 160. The recording sheet S on which an image has been formed is ejected from image forming apparatus 100 by sheet ejecting section 153 including sheet ejecting roller 153*a*.

[Configuration of Fixing Unit 161]

Figure 3:
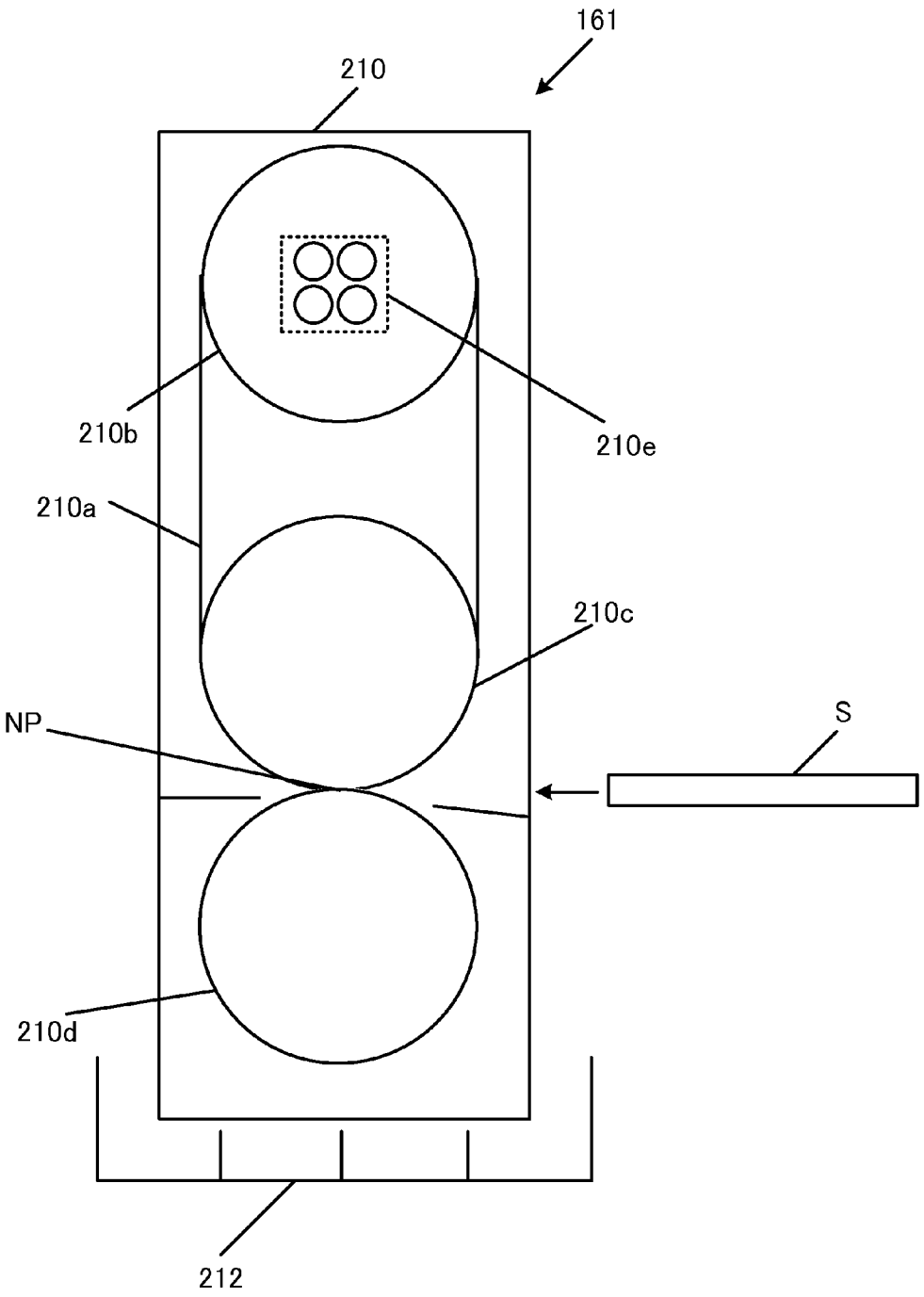
FIG. 3 illustrates a configuration of a fixing unit of the present embodiment.

Next, the configuration of fixing unit 161 is described referring to FIG. 3. Fixing unit 161 employs a belt heating system. Fixing unit 161 includes casing member 210, and has an upper pressing section and a lower pressing section that form the fixing nip portion inside casing member 210. The upper pressing section includes heating roller 210*b* and fixing roller 210*c*. Endless fixing belt 210*a* is installed in a stretched state between heating roller 210*b* and fixing roller 210*c* at a predetermined belt tension (for example, 40 [N]). The lower pressing section has pressing roller 210*d*. The lower pressing section may also be a belt structure that includes a belt that is rotatably driven by a pair of rollers. Pressing roller 210*d* is pressed against fixing roller 210*c* through fixing belt 210*a* with a predetermined fixing load (for example, 1000[N]). Thus, fixing nip portion NP that pinches and conveys recording sheet S is formed between fixing roller 210*c* and pressing roller 210*d*.

Fixing belt 210*a* comes into contact with recording sheet S having a toner image formed thereon, and heats the recording sheet S at a fixing temperature (for example, 160 to 200[° C.]). In this case, the term "fixing temperature" refers to a temperature that can supply an amount of heat required to melt the toner on recording sheet S, and the fixing temperature varies depending on the sheet type and the like of the recording sheet on which the image is to be formed.

Fixing belt 210*a* is made, for example, by covering an outer circumferential surface of a substrate made of polyimide (PI) having a thickness of 70 [μm] with heat-resistant silicone rubber (hardness: JIS-A30[°]) having a thickness of 200 [μm] as an elastic layer, and coating the surface layer with PFA (perfluoroalkoxy) that is a heat-resistant resin having a thickness of 30 [μm].

Heating roller 210*b* heats fixing belt 210*a*. Heating roller 210*b* incorporates therein halogen heater 210*e* that heats fixing belt 210*a*. Heating roller 210*b*, for example, is made by covering an outer circumferential surface of a cylindrical metal core that is formed of aluminum or the like with a resin layer of coated PTFE. In order to support different sheet widths, halogen heater 210*e* includes, for example, one 1000 [W] heater element and two 800 [W] heater elements, and these heater elements are arranged so as to form different heat generation distributions in the axial direction to correspond with different sheet widths of recording sheets S.

The temperature of halogen heater 210*e* is controlled by controlling section 200. Heating roller 210*b* is heated by halogen heater 210*e*, and as a result fixing belt 210*a* is heated.

Fixing roller 210*c* constitutes, together with pressing roller 210*d*, a pressing section for forming fixing nip portion NP. Driving control of fixing roller 210*c* (for example, control to turn rotation on/off, and control of the number of rotations) is performed by controlling section 200.

Fixing roller 210*c* is made, for example, by covering a solid metal core formed from a metal such as iron with heat-resistant silicone rubber (hardness: JIS-A5[°]) having a thickness of 10 to 20 [mm] as an elastic layer, and covering the silicone rubber with a resin layer of coated PTFE that is a heat-resistant resin having low frictional properties with a thickness of 30 [μm].

Pressing roller 210*d* constitutes, together with fixing roller 210*c*, the pressing section for forming fixing nip portion NP. Pressing roller 210*d* is pushed against fixing roller 210*c* through fixing belt 210*a* by a pushing section (omitted from the drawings). Driving control of pressing roller 210*d* (for example, control to turn rotation on/off, and control of the number of rotations) is performed by controlling section 200.

Pressing roller 210*d* is made by covering an outer circumferential surface of a cylindrical metal core that is formed from aluminum or the like with heat-resistant silicone rubber (hardness: JIS-A30[°]) having a thickness of 1 to 5 [mm] as an elastic layer, and covering the silicone rubber with a resin layer formed of a PFA tube with a thickness between 30 and 100 [μm].

A fixing speed of fixing unit 161 is, for example, 100 to 500 [mm/s] As used herein, the term "fixing speed" refers to a speed at which recording sheet S passes through fixing nip portion NP formed by fixing roller 210*c* and pressing roller 210*d*.

Base member 212 supports casing member 210 so as to be capable of being translated in a direction that is orthogonal to the conveying direction of recording sheet S (hereunder, referred to as "orthogonal direction").

[Translation Mechanism of Casing Member 210]

Figure 4A:
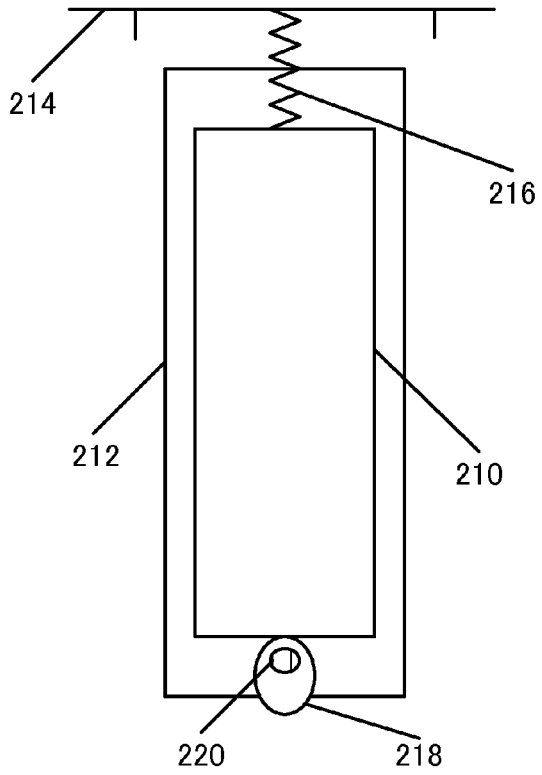
FIGS. 4A and 4B illustrate a translation mechanism of the fixing unit of the present embodiment.
Figure 4B:
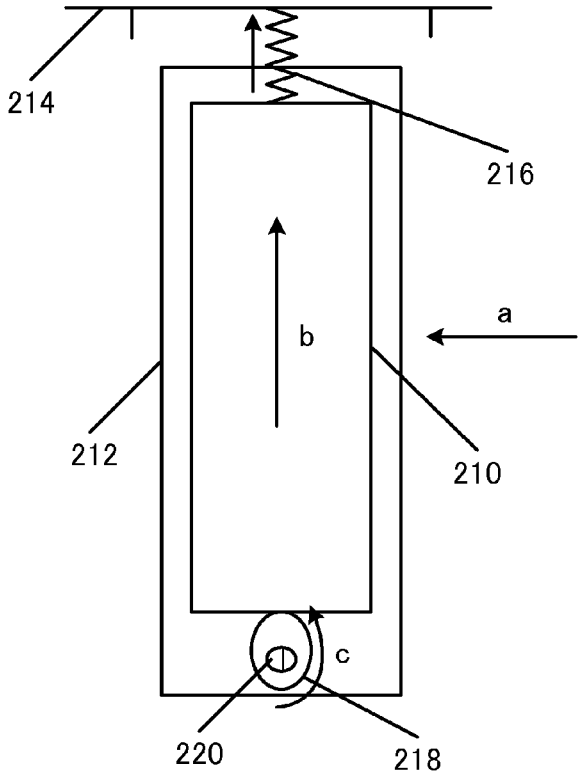

Next, a translation mechanism of casing member 210 that houses fixing unit 161 is described referring to FIGS. 4A and 4B. FIGS. 4A and 4B illustrate casing member 210 as viewed from a top face in FIG. 3.

As shown in FIGS. 4A and 4B, fixing slide cam 218 that is provided on the image forming apparatus 100 body side is arranged on the frontward side of casing member 210 that is the operation section 122 side of image forming apparatus 100. Further, slide spring 216 that contacts the back side of casing member 210 and urges casing member 210 towards the fixing slide cam 218 side is arranged on rear-side plate 214 of image forming apparatus 100. Fixing slide cam 218 and slide spring 216 function as translation section 180. That is, fixing unit 161 is translated in an orthogonal direction by translation section 180.

In the state shown in FIG. 4A, casing member 210 is receiving the urging force of slide spring 216 and the front side of casing member 210 is thereby being pushed against fixing slide cam 218.

In the above described state, when fixing slide cam 218 is rotated around pivot 220 in the direction of arrow c as shown in FIG. 4B, casing member 210 can move in an orthogonal direction (arrow b direction) to the conveying direction (arrow a direction) on base member 212. Controlling section 200 performs control relating to rotation of fixing slide cam 218 (for example, turning rotation on and off). Controlling section 200 controls translation section 180 such that translation section 180 continuously or intermittently translate fixing unit 161.

As the result of translating fixing unit 161, on the surface layers of fixing belt 210*a* and pressing roller 210*d* of fixing unit 161, an abrasion difference arises between portions against which edge portions of recording sheets S contact and portions against which the edge portions of recording sheets S do not contact. Therefore, when an unfixed toner image is thermally fixed onto recording sheet S by the surface layers of fixing belt 210*a* and pressing roller 210*d* in which an abrasion difference has arisen, a gloss difference occurs in an image that is ultimately formed on recording sheet S. The gloss difference occurs, in particular, in the case of successively forming toner images of the same image or of the same image width on recording sheets S.

Figure 5A:
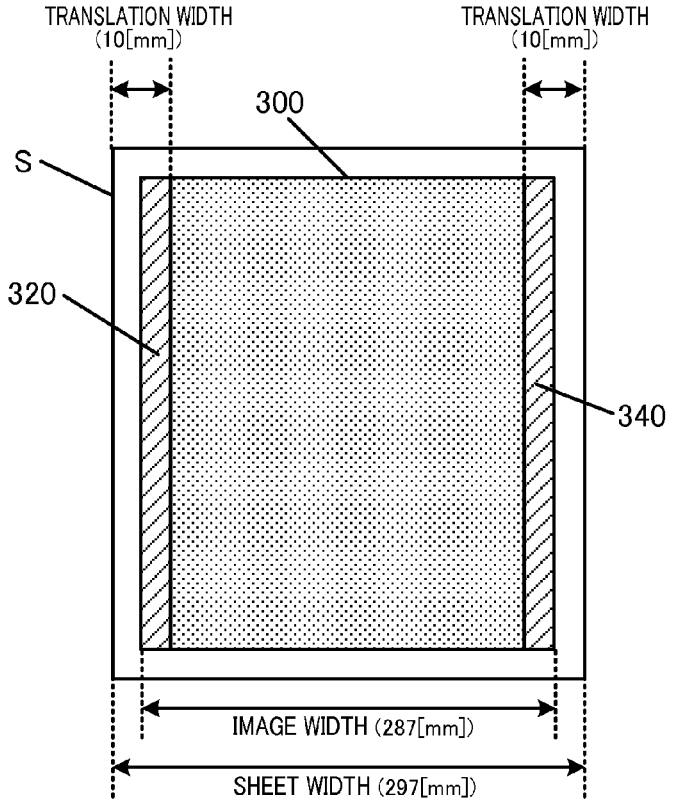
FIGS. 5A and 5B illustrate the relationship between a translation amount of the fixing unit and an image width of a toner image to be formed on a recording sheet.

The mechanism by which the aforementioned gloss difference occurs will now be described specifically referring to FIG. 5A. In a case where the translation amount of fixing unit 161 is set, for example, to 10(±5) [mm] and fixing unit 161 is translated, portions on the surface layers of fixing belt 210*a* and pressing roller 210*d* that were abraded by contact against the edge portions of recording sheets S come in contact with areas of a width of 10 [mm] from both the left and right edges towards the inside of recording sheet S. As shown in FIG. 5A, when toner image 300 having an image width (for example, 287 [mm]) whose left and right edges are each 5 [mm] narrower relative to the sheet width (for example, 297 [mm]) of recording sheet S is formed continuously on recording sheets S, the abraded portions of the surface layers of fixing belt 210*a* and pressing roller 210*d* contact against areas 320 and 340 of a width of 5 [mm] from the left and right edges towards the inside of toner image 300. Consequently, in toner image 300 that is ultimately formed on recording sheet S, a gloss difference occurs between areas 320 and 340 and areas other than areas 320 and 340.

Thus, in the present embodiment, controlling section 200 controls so that a translation amount of fixing unit 161 becomes one-half of a value obtained by subtracting the image width of a toner image to be formed on recording sheet S from the sheet width of the relevant recording sheet S. In the example illustrated in FIG. 5A, controlling section 200 sets a translation amount of fixing unit 161 to one-half (=5 [mm]) of the value obtained by subtracting the image width of the toner image to be formed on recording sheet S from the sheet width of the relevant recording sheet S. It is to be noted that when an operation to form a toner image is performed with a so-called borderless setting (full-bleed) that forms the toner image as far as the edges of recording sheet S, the translation amount of fixing unit 161 is set to 0 [mm] so that the sheet width of recording sheet S and the image width of the toner image to be formed on recording sheet S become the same value. That is, fixing unit 161 is not translated.

Figure 5B:
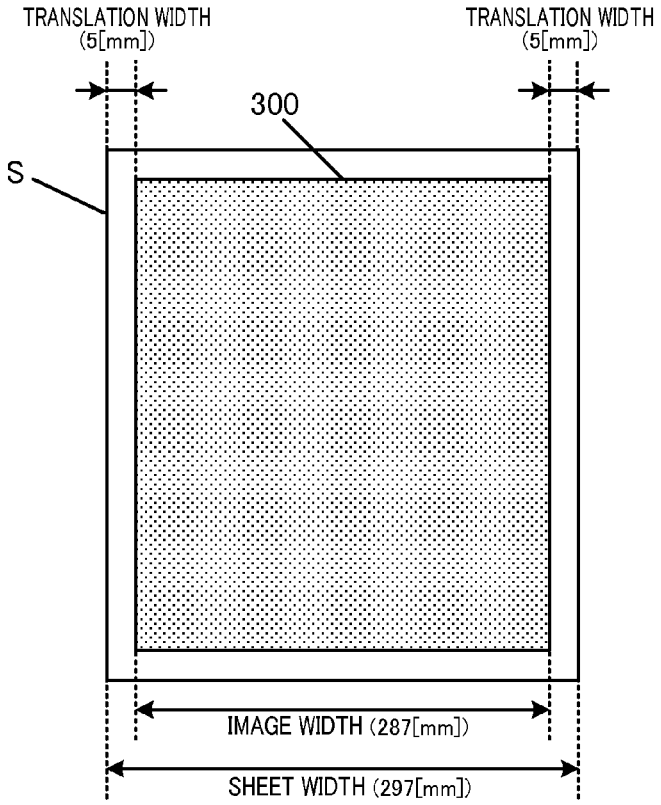

As a result, as shown in FIG. 5B, even when toner image 300 having an image width whose left and right edges are each narrower by 5 [mm] relative to the sheet width of recording sheet S is continually formed on recording sheets S, abraded portions of the surface layers of fixing belt 210*a* and pressing roller 210*d* do not come in contact with toner image 300. Thus, the occurrence of a gloss difference in toner image 300 that is ultimately formed on recording sheet S can be prevented.

Figure 6:
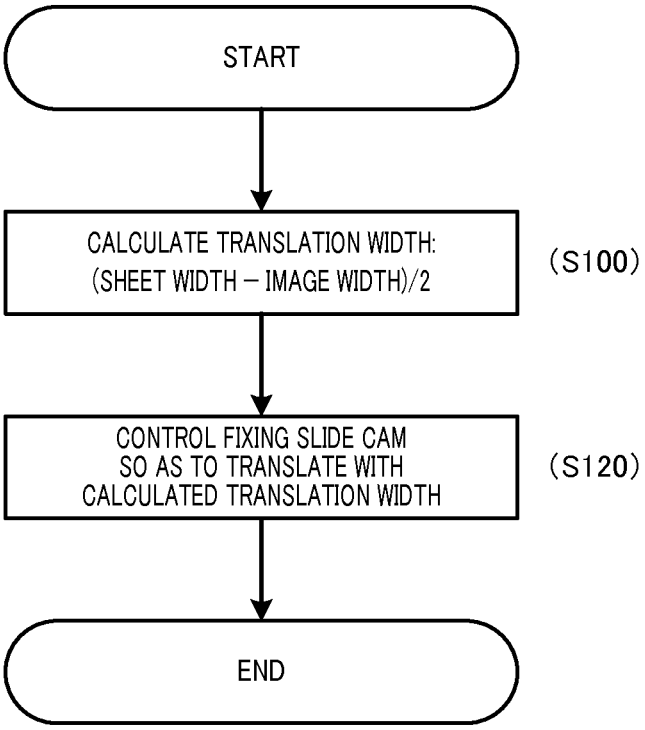
FIG. 6 is a flowchart that illustrates a translation control operation of the present embodiment.

Next, a translation control operation of image forming apparatus 100 is described with reference to the flowchart in FIG. 6. The respective processing operations illustrated in FIG. 6 are executed each time image forming processing that corresponds to a single print job that is assigned to image forming apparatus 100 is performed.

[Control Operation of Image Forming Apparatus 100]

First, controlling section 200 calculates a value that is one-half of a value obtained by subtracting the image width of the toner image from the sheet width of recording sheet S as the translation amount of fixing unit 161 (step S100). In this case, controlling section 200 refers to print job information that is stored in storage section 172 and identifies the sheet width of recording sheet S based on information indicating the sheet size that is one item in the settings information. In addition, controlling section 200 refers to image guarantee area width information that is stored in storage section 172 to identify the image width of the toner image.

Next, controlling section 200 controls a rotational amount of fixing slide cam 218 so that fixing unit 161 is translated by a translation amount calculated in step S100 (step S120). Controlling section 200 controls fixing slide cam 218 so as to continuously or intermittently translate fixing unit 161 by a translation amount calculated in step S100 until image forming processing corresponding to the print job ends. It is to be noted that a configuration may also be adopted in which fixing unit 161 is continuously or intermittently translated only when recording sheet S is passing through or is not passing through fixing nip portion NP. Upon completing the processing in step S120, image forming apparatus 100 ends the processing illustrated in FIG. 6.

As described in detail above, image forming apparatus 100 of the present embodiment includes: fixing unit 161 that heats and presses recording sheet S having a toner image formed thereon, by means of fixing nip portion NP to fix the toner image onto recording sheet S; translation section 180 that translates fixing unit 161 in a direction that is orthogonal to a conveying direction of recording sheet S; and controlling section 200 that controls translation section 180 so that fixing unit 161 is translated by a translation amount (5 [mm]) that is one-half of a value obtained by subtracting the image width (287 [mm]) of the toner image from the sheet width (297 [mm]) of recording sheet S.

According to the present embodiment configured in this manner, as shown in FIG. 5B, even when toner image 300 having an image width whose left and right edges are each narrower by 5 [mm] relative to the sheet width of recording sheet S is continually formed on recording sheets S, abraded portions of the surface layers of fixing belt 210*a* and pressing roller 210*d* do not come in contact with toner image 300. Thus, the occurrence of a gloss difference in toner image 300 that is ultimately formed on recording sheet S can be prevented.

According to the present embodiment, the translation amount of fixing unit 161 is controlled so as to be an amount that is one-half of a value obtained by subtracting the image width of the toner image from the sheet width of recording sheet S, that is, so as to be a width that is just narrow enough to ensure that abraded portions of the surface layers of fixing belt 210*a* and pressing roller 210*d* do not come in contact with toner image 300. According to this configuration, the translation amount of fixing unit 161 can be increased to the maximum to more reliably prevent the occurrence of sheet edge scratches while preventing a gloss difference occurring in an image that is ultimately formed on recording sheet S.

It is to be noted that, in the above-mentioned embodiment, translation section 180 may also be controlled so that fixing unit 161 is translated by a translation amount that is less than one-half of a value obtained by subtracting the image width of the toner image from the sheet width of recording sheet S.

In addition, although in the above-mentioned embodiment an example was described in which the image width is an actual image area width that defines a maximum width of an actual image area in which a toner image is formed on recording sheet S, the present invention is not limited thereto. For example, the image width may be an actual image area width that defines a maximum width of an actual image area n which a toner image is formed on recording sheet S. According to this configuration, since the translation amount of fixing unit 161 can be increased to the maximum in accordance with a toner image to be formed on recording sheet S, the translation amount of fixing unit 161 can be increased to the maximum to more reliably prevent the occurrence of sheet edge scratches while preventing a gloss difference occurring in an image that is ultimately formed on recording sheet S. In this case, image processing section 130 identifies the actual image area width during the course of performing a digital image process on the input image data, and notifies the identified actual image area width to controlling section 200. Controlling section 200 calculates the translation amount of fixing unit 161 using the actual image area width that is notified from image processing section 130.

Further, although in the above-mentioned embodiment an example was described in which casing member 210 is urged in the sheet conveying direction by slide spring 216, and casing member 210 is moved by rotation of slide cam 218, the present invention is not limited thereto. For example, a configuration may also be adopted in which a rack gear is provided in the longitudinal direction (orthogonal direction) of casing member 210, and a pinion gear is further provided that intermeshes with the rack gear and rotates, in which casing member 210 is moved in the orthogonal direction by rotating the pinion gear.

Figure 7:
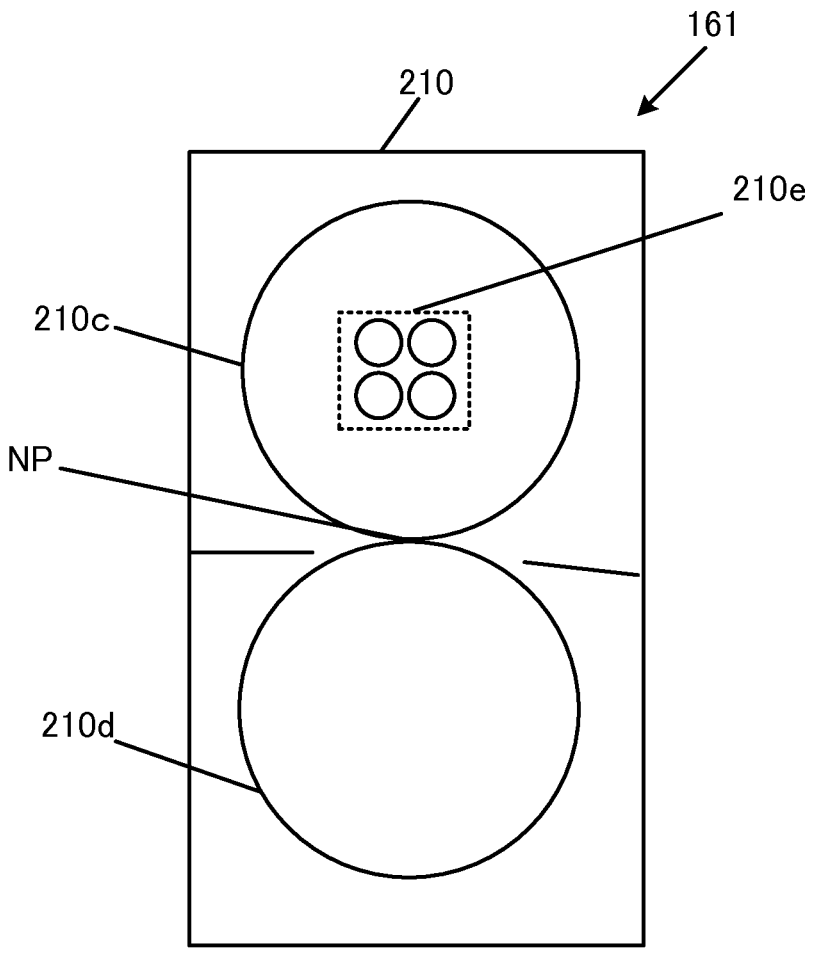
FIG. 7 illustrates a configuration of a fixing unit that illustrates an embodiment according to the present invention.

Furthermore, in the above-mentioned embodiment a configuration may also be adopted in which, as shown in FIG. 7, fixing unit 161 includes pressing roller 210*d* that presses recording sheet S at fixing nip portion NP, and fixing roller 210*c* that forms fixing nip portion NP together with pressing roller 210*d*.

It should be understood by those skilled in the art that various modifications, combinations, sub-combinations and alterations may occur depending on design requirements and other factors in so far as they are within the scope of the appended claims or the equivalents thereof.

What is claimed is:

1. An image forming apparatus, comprising:

a fixing unit that heats and presses a recording sheet having a toner image formed thereon, by means of a fixing nip portion to thereby fix the toner image onto the recording sheet;

a translation section that translates the fixing unit in a direction that is orthogonal to a conveying direction of the recording sheet; and a controlling section that controls the translation section so that the fixing unit is translated by a translation amount that is equal to or less than one-half of a value obtained by subtracting an image width of the toner image from a sheet width of the recording sheet.

2. The image forming apparatus according to claim 1, wherein the controlling section controls the translation section so that the translation amount becomes one-half of a value obtained by subtracting the image width of the toner image from the sheet width of the recording sheet.

3. The image forming apparatus according to claim 1, wherein the image width is an image guarantee area width that defines a maximum width that guarantees a quality of a toner image to be formed on the recording sheet.

4. The image forming apparatus according to claim 1, wherein the image width is an actual image area width that defines a maximum width of an actual image area in which a toner image is to be formed on the recording sheet.

5. A translation control method for an image forming apparatus comprising a fixing unit that heats and presses a recording sheet having a toner image formed thereon, by means of a fixing nip portion to thereby fix the toner image onto the recording sheet, the method comprising:

a first step of calculating a value that is one-half of a value obtained by subtracting an image width of the toner image from a sheet width of the recording sheet as a translation amount of the fixing unit; and a second step of controlling so that the fixing unit is translated in a direction that is orthogonal to a conveying direction of the recording sheet with a translation amount that is equal to or less than the translation amount calculated in the first step.

6. The translation control method according to claim 5, wherein the second step is a step of controlling so that the fixing unit is translated in a direction that is orthogonal to a conveying direction of the recording sheet with the translation amount calculated in the first step.

7. The translation control method according to claim 5, wherein the image width is an image guarantee area width that defines a maximum width that guarantees a quality of a toner image to be formed on the recording sheet.

8. The translation control method according to claim 5, wherein the image width is an actual image area width that defines a maximum width of an actual image area in which a toner image is to be formed on the recording sheet.

* * * * *